US008191239B2

(12) United States Patent
Lee et al.

(10) Patent No.: US 8,191,239 B2
(45) Date of Patent: Jun. 5, 2012

(54) METHOD FOR FABRICATION CONDUCTIVE WINDING STRUCTURE

(75) Inventors: Ming-Tsung Lee, Taoyuan Hsien (TW); Yung-Yu Chang, Taoyuan Hsien (TW); Chen-Yu Yu, Taoyuan Hsien (TW); Jui-Yuan Hsu, Taoyuan Hsien (TW); Chen-Tsai Hsieh, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 612 days.

(21) Appl. No.: 12/326,242

(22) Filed: Dec. 2, 2008

(65) Prior Publication Data

US 2009/0293260 A1 Dec. 3, 2009

(30) Foreign Application Priority Data

Jun. 2, 2008 (TW) ..... 97120488 A

(51) Int. Cl.
*H01F 7/06* (2006.01)

(52) U.S. Cl. ..... 29/605; 29/602.1; 29/606; 335/299; 336/212; 336/222; 336/223; 336/224

(58) Field of Classification Search ..... 29/602.1, 29/605, 606; 335/299; 336/212, 222, 223, 336/234

See application file for complete search history.

(56) References Cited

U.S. PATENT DOCUMENTS

| | | | | |
|---|---|---|---|---|
| 3,464,898 | A * | 9/1969 | Norris | 205/73 |
| 5,160,421 | A * | 11/1992 | Melnyk et al. | 205/67 |
| 5,207,887 | A * | 5/1993 | Crumly et al. | 205/78 |
| 2002/0056643 | A1 * | 5/2002 | Watanabe | 205/73 |

FOREIGN PATENT DOCUMENTS

CN 1130291 A 9/1996

* cited by examiner

*Primary Examiner* — Paul D Kim
(74) *Attorney, Agent, or Firm* — Kirton McConkie; Evan R. Witt

(57) ABSTRACT

A conductive winding structure, the fabricating method thereof, and the magnetic device having the same. The method for fabricating the conductive winding structure includes: (a) providing a mold with a plurality of extension portions and a plurality of protrusions, the plurality of extension portions are connected to each other as a continuous spiral structure, and the plurality of protrusions extend from the plurality of extension portions; (b) performing an electroforming procedure to form a conductive layer on partial surface of the mold; and (c) stripping the conductive layer from the mold, so as to obtain the conductive winding structure.

8 Claims, 10 Drawing Sheets

10'

METHOD FOR FABRICATION CONDUCTIVE WINDING STRUCTURE

FIELD OF THE INVENTION

The present invention relates to a conductive winding structure, the fabricating method thereof and the magnetic device having the same, and more particularly to a thin conductive winding structure, the fabricating method thereof and the magnetic device having the same.

BACKGROUND OF THE INVENTION

Generally speaking, magnetic devices, such a transformer, inductance, and etc., are disposed in electronic equipment. To match the trend of reducing the thickness of the electronic equipment, the magnetic devices of the electronic equipment and the conductive winding structure applied in the magnetic devices have to be thinned, so as to decrease the whole volume of the electronic equipment.

Take transformer for example, the wires are wound on the bobbin to serve as the primary winding and the secondary winding of the transformer in the conventional technique. Since certain amount of space on the bobbin has to be preserved for winding the primary and seconding windings, the volume of the transformer cannot be reduced. A technique of forming the conductive winding structure with the cut copper sheet developed to replace the wire winding technique can decrease the thickness of the conductive winding structure; however, to produce a conductive winding structure with multiple windings, several single cut copper sheets have to be soldered together, or a whole copper sheet with specific shape has to be folded. In other words, the additional soldering or folding process has to be performed after cutting the copper sheet, which complicates the fabricating method. In addition, the thickness uniformity of the conductive winding structure is easily impacted owing to the soldering media or folding, and the structural damage and fold are easily created due to the folding process. The non-uniform thickness and the structural damage of the conductive winding structure will increase the power loss. Besides, when a thin copper sheet is folded, it may break easily. Hence the electrical property of the conductive winding structure and the efficiency and product yield of the transformer will be affected as well.

There is another technique of bending the flat cable with width larger than thickness by machine to form the conductive winding structure with multiple windings for lowering power loss; however, the width/thickness ratio of the flat cable used in this technique is usually smaller than 20. That is to say, when the thickness of the flat cable is reduced or the width/thickness ratio of the flat cable is increased, the conductive winding structure cannot be produced because the outer diameter and the inner diameter thereof may break and wrinkle respectively due to the insufficient malleability of the flat cable. In addition, a cable has only two terminals, and thus the conductive winding structure formed by bending a flat cable has only two conductive pins extended therefrom. Therefore, the application of the conductive winding structure with only two conductive pins will be limited. Though additional conductive pins can be soldered on the conductive winding structure to increase the number thereof, the processing procedure is complicated and time-consuming. It is to be understood that the conductive winding structure fabricated by the conventional techniques cannot satisfy the requirements for reducing the thickness and improving the electrical property thereof at the same time.

Accordingly, it is required to develop a conductive winding structure, a fabricating method thereof, and a magnetic device having the same to overcome the foregoing defects.

SUMMARY OF THE INVENTION

An object of the present invention is to provide a conductive winding structure, the fabricating method thereof, and the magnetic device having the same, so as to satisfy the requirements of improving the electrical property, reducing the thickness, and diversifying the configuration of the conductive winding structure. Thus the trend to develop thin and high efficiency magnetic device can be matched by applying the conductive winding structure of the present invention in the magnetic device. The conductive winding structure of the present invention is formed by electroforming, and thus the processes of cutting, soldering or folding the metal sheet or bending the flat cable are no longer necessary. Since the conductive winding structure with multiple windings can be integrally formed without folding, the non-uniform thickness of the conductive winding structure caused by soldering or folding can be avoided, and the fold caused by folding can be prevented as well. Therefore, the power loss of the conductive winding structure can be reduced, and the electrical property of the conductive winding structure can be improved. In addition, the thickness of the conductive winding structure can be modified and reduced by adjusting the time or other related parameters of electroforming process, and the conductive winding structure with different shapes can be fabricated by changing the configuration of the mold. Thus the application of the conductive winding structure can be diversified.

According to an aspect of the present invention, a method for fabricating a conductive winding structure is provided. The fabricating method comprises steps of: (a) providing a mold; (b) performing an electroforming procedure to form a conductive layer on partial surface of the mold; and (c) stripping the conductive layer from the mold, so as to obtain the conductive winding structure.

In an embodiment, the mold in step (a) further comprises a plurality of extension portions and a plurality of protrusions, the extension portions are connected to each other as continuous spiral structure, and the protrusions are extended from the extension portions. The mold further comprises an axle portion substantially surrounded by the extension portions.

In an embodiment, the conductive layer in step (b) is formed on partial surface of the extension portions and the protrusions of the mold.

In an embodiment, the conductive winding structure in step (c) comprises a plurality of main bodies, a plurality of conductive pins, and a hollow portion respectively corresponded to the extension portions, the protrusions, and the axle portion of the mold.

In an embodiment, the main bodies and the conductive pins of the conductive winding structure are integrally formed without folding.

In an embodiment, the mold in step (a) is selected from a conductive material, and step (a) further comprises sub-step of: (a1) performing an insulating treatment on the mold to form an insulating medium on the mold except partial surface of the extension portions and the protrusions applied to contact with the conductive layer, so the conductive layer is formed on partial surface of the extension portions and the protrusions in step (b) via the conductive material.

In an embodiment, the mold in step (a) is selected from an insulating material, and step (a) further comprises sub-step of: (a1) performing a conductive treatment on the mold to form a conductive medium on partial surface of the extension portions and the protrusions applied to contact with the conductive layer, so the conductive layer is formed on partial surface of the extension portions and the protrusions in step (b) via the conductive medium.

In an embodiment, the conductive winding structure in step (c) is selected from a group consisting of copper and nickel, and the thickness of the conductive winding structure is substantially smaller than 1 mm.

According to another aspect of the present invention, there is provided a conductive winding structure applied in a magnetic device, wherein the conductive winding structure is formed by the fabricating method of the present invention.

In an embodiment, the conductive winding structure is integrally formed without folding and comprises a plurality of main bodies, a plurality of conductive pins, and a hollow portion.

In an embodiment, the magnetic device is a transformer or an inductance.

According to the other aspect of the present invention, there is provided a magnetic device. The magnetic device comprises a conductive winding structure formed by the fabricating method of the present invention and a magnetic core assembled with the conductive winding structure.

In an embodiment, the magnetic core is partially disposed in the hollow portion of the conductive winding structure.

In an embodiment, the magnetic device is an inductance or a transformer. The transformer further comprises a primary winding, and the primary winding is wound on a bobbin of the transformer.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
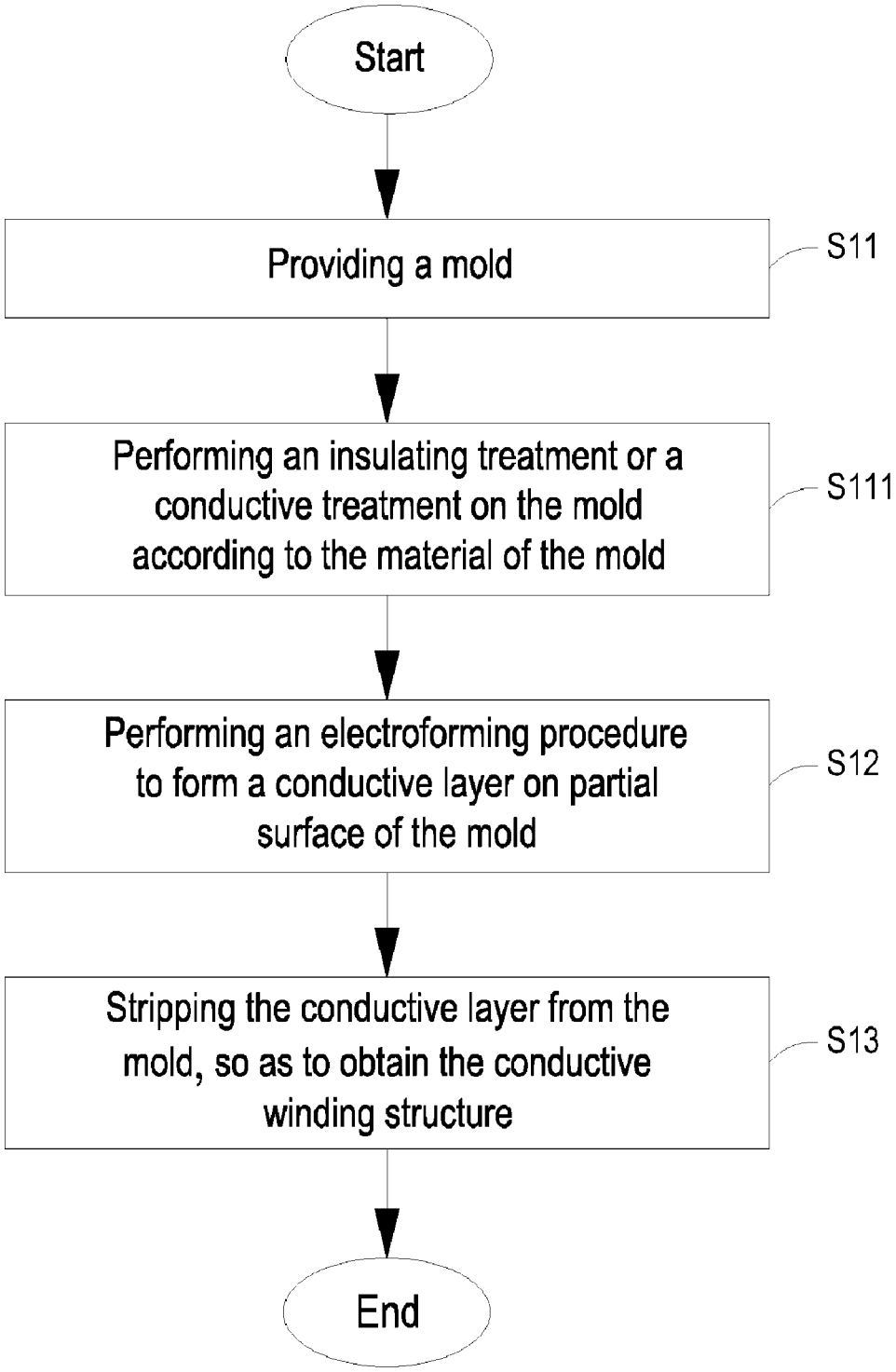
FIG. 1 is a flow chart showing the method for fabricating the conductive winding structure according to the first preferred embodiment of the present invention.
Figure 2A:
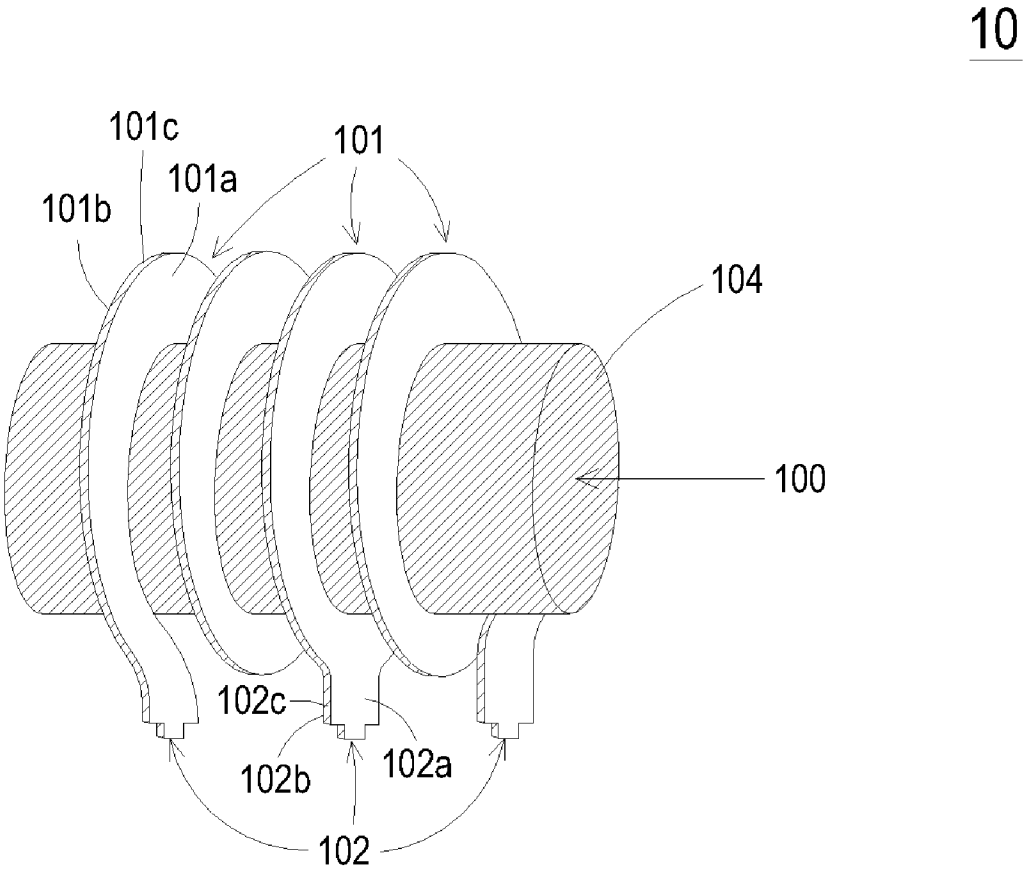
FIG. 2A is a schematic diagram showing the structure of the mold according to one embodiment of the present invention.
Figure 2B:
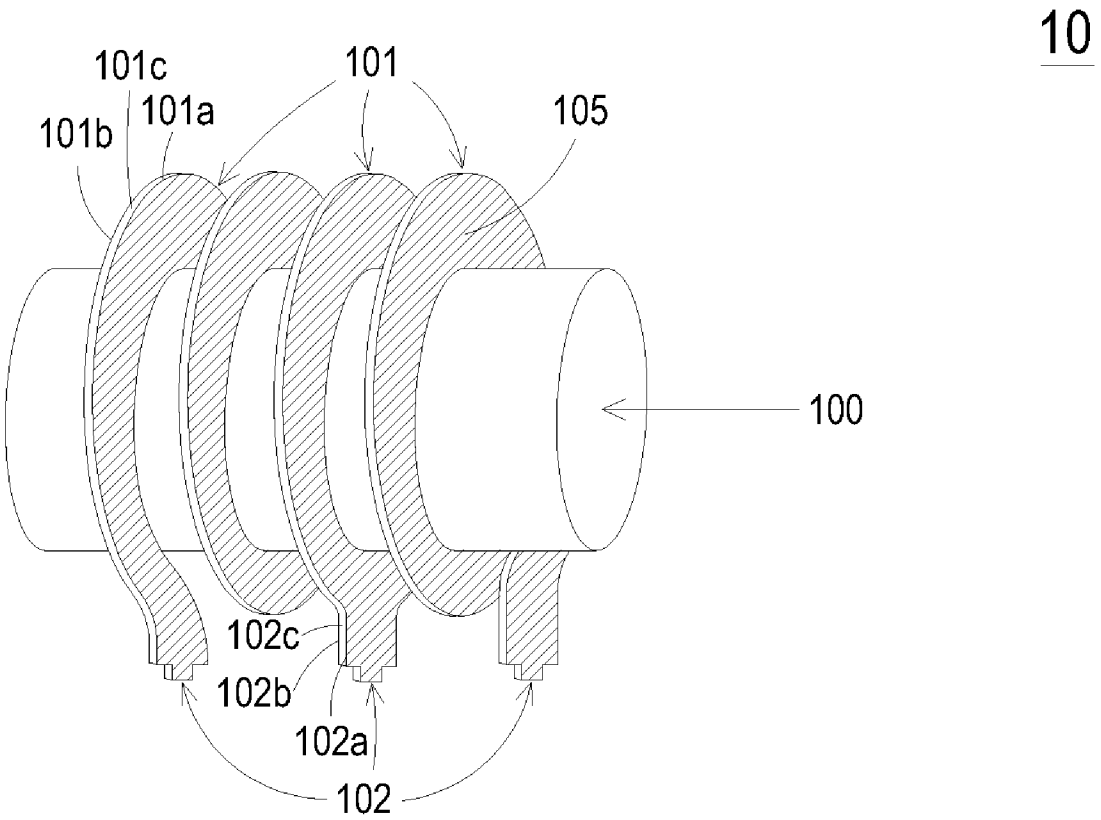
FIG. 2B is a schematic diagram showing the structure of the mold according to another embodiment of the present invention.
Figure 4A:
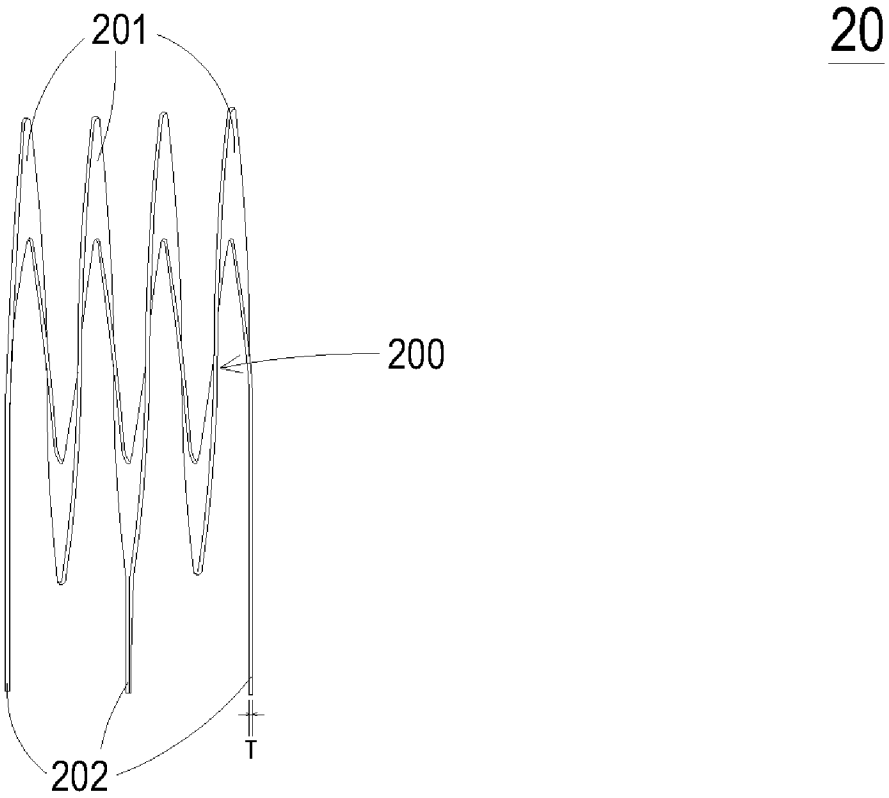
FIG. 4A is a lateral view showing the conductive winding structure formed by the fabricating method according to FIG. 1.
Figure 4B:
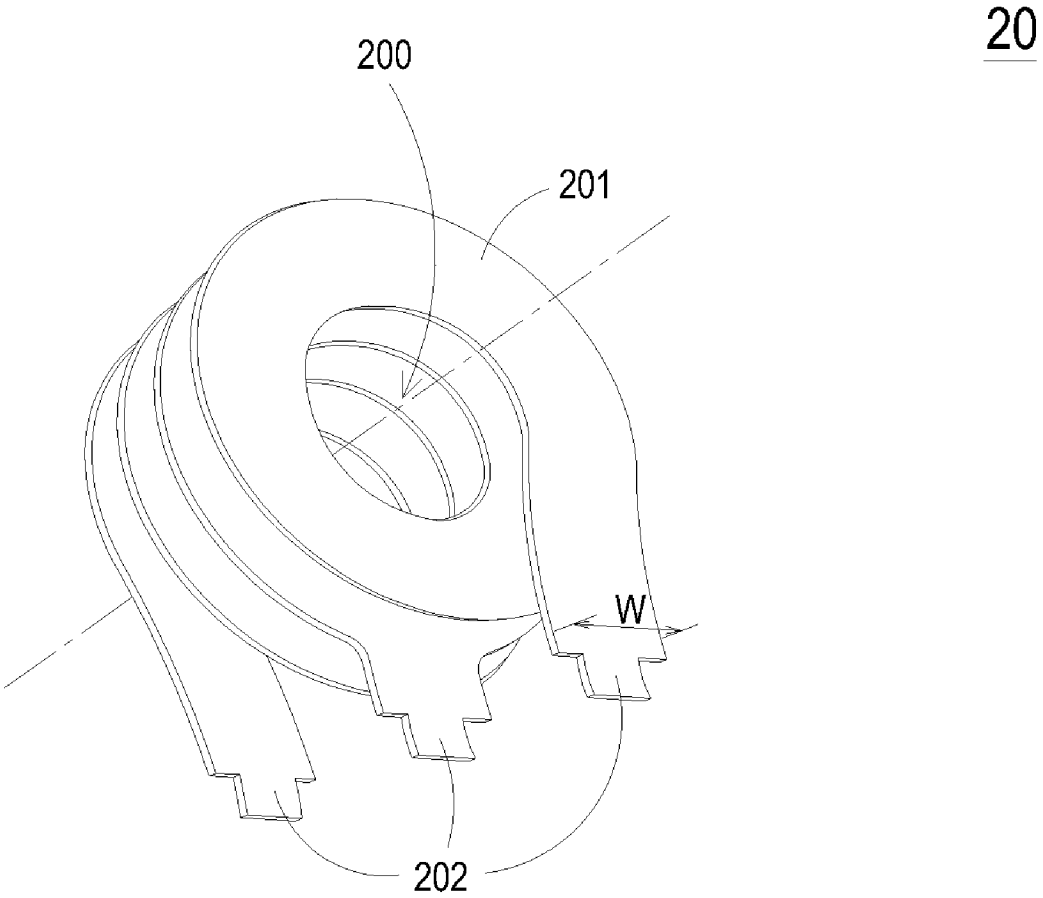
FIG. 4B is a schematic diagram showing the structure of the conductive winding structure of FIG. 4A.

The conductive winding structure of the present invention can be applied in the magnetic device such as transformer, inductance, and etc., but not limited thereto. Please refer to FIG. 1, which is a flow chart showing the method for fabricating the conductive winding structure according to the first preferred embodiment of the present invention. As shown in FIG. 1, to fabricate the conductive winding structure, a mold 10 is provided (step S11). The mold 10 is preferred to be integrally formed, but not limited thereto, which also can be formed by assembling or soldering each elements of the mold 10. FIGS. 2A and 2B illustrate the structures of the mold according to the preferred embodiments of the present invention. As shown in FIGS. 2A and 2B, the mold 10 comprises an axle portion 100, a plurality of extension portions 101, and a plurality of protrusions 102. The axle portion 100, the extension portions 101, and the protrusions 102 of the mold 10 can be formed by cutting a pillar structure, such as lathe process, but not limited thereto. In this embodiment, the extension portions 101 are substantially circular and successively connected to each other as a continuous spiral structure. The extension portions 101 also surround the axle portion 100 in regular intervals. Each of the extension portions 101 has a first side 101*a*, a second side 101*b*, and a peripheral side 101*c*, wherein the first and second sides 101*a* and 101*b* are corresponded to each other, and the peripheral side 101*c* is disposed between the first and second sides 101*a* and 101*b*. The plural protrusions 102 are integrally extended from the edge of the extension portions 101, and the thickness of each protrusion 102 is equal to that of each extension portion 101. In other words, the extension portions 101 and the protrusions 102 are continuous structure. Each of the protrusions 102 also comprises a first side 102*a*, a second side 102*b*, and a peripheral side 102*c*, wherein the peripheral side 102*c* is disposed between the first and second sides 102*a* and 102*b* which corresponded to each other. The first sides 101*a* of the extension portions 101 and the first sides 102*a* of the protrusions 102 face toward the same direction, and the second sides 101*b* of the extension portions 101 and the second sides 102*b* of the protrusions 102 face toward the same direction opposite to that of the first sides 101*a* and 102*a*. Therefore, the first sides 101*a* of the extension portions 101 and the first sides 102*a* of the protrusions 102 form a flat and continuous surface, as well as the second sides 101*b*, 102*b* and the peripheral sides 101*c*, 102*c*, so as to produce an integrally formed conductive winding structure 20 without fold (as shown in FIGS. 4A and 4B) via partial surface of the extension portions 101 and protrusions 102 of the mold 10. In addition, the numbers and locations of the extension portion 101 and the protrusion 102 are not limited, which can be modified according to different requirements of the conductive winding structure 20. In this embodiment, the mold 10 is illustrated with four extension portions 101 and three protrusions 102 as an example.

Please refer to FIG. 1, FIG. 2A and FIG. 2B, wherein FIGS. 2A and 2B are schematic diagrams showing the structure of the mold according to different embodiments of the present invention. The material of the mold 10 is not limited in the present invention. However, a suitable mold pretreatment, such as insulating treatment or conductive treatment, has to be conducted before performing the electroforming procedure according to the material of the mold 10 (step S111). For example, when the mold 10 is selected from a conductive material, an insulating treatment has to be performed on partial surface of the mold 10, so as to define the area for forming the conductive layer 103 in the following electroforming procedure and prevent the conductive layer 103 from forming on the non-predetermined location of the mold 10. In other words, an insulating medium 104, such as insulating paint, can be coated on the surface of the axle portion 100 and the second sides 101*b*, 102*b* and peripheral sides 101*c*, 102*c* of the extension portions 101 and the protrusions 102 (as shown in FIG. 2A). Accordingly, since the exterior of the mold 10 is covered by the insulating medium 104 except the first sides 101*a* and 102*a* of the extension portions 101 and the protrusions 102 applied to contact with the conductive layer 103, the conductive layer 103 can be formed only on the first sides 101*a* and 102*a* of the extension portions 101 and protrusions 102 in the following step via the exposed conductive material of the mold 10.

Of course, when the mold 10 is selected from an insulating material, a conductive treatment has to be performed on partial surface of the mold 10 applied to contact with the conductive layer 103 in the following step. In the embodiment shown in FIG. 2B, a conductive medium 105 can be disposed on the first sides 101*a* and 102*a* of the extension portions 101 and the protrusions 102 of the mold 10, wherein the first sides 101*a* and 102*a* are applied to contact with the conductive layer 103 in the following procedure. The conductive medium 105, such as conductive paint, metal powder, graphite, and etc., can be coated on the first sides 101*a* and 102*a*, so as to form the conductive layer 103 on the first sides 101*a* and 102*a* of the extension portions 101 and the protrusions 102 of the mold 10 in the following step via the conductive medium 105.

Figure 3:
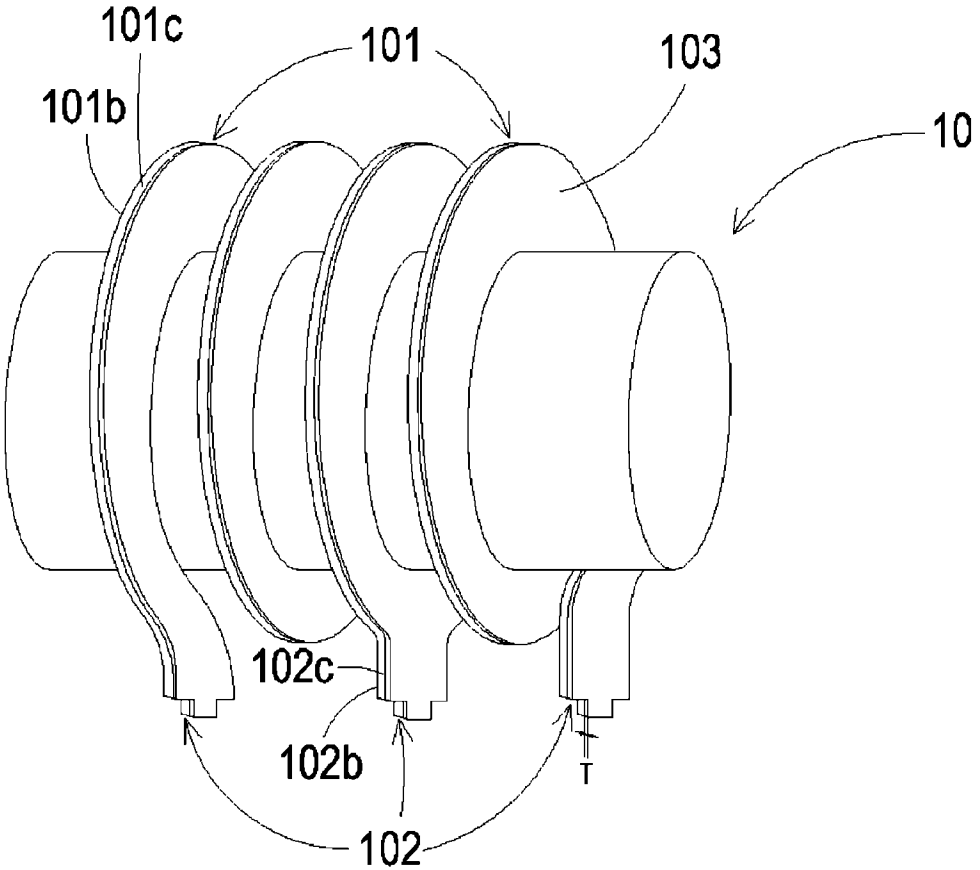
FIG. 3 is a schematic diagram showing the conductive layer formed on partial surface of the mold.

After the pretreatment of the mold 10, the electroforming procedure is performed to form the conductive layer 103 on partial surface of the mold 10 (step S12). During the electroforming procedure of step S12, the mold 10 is disposed at the cathode of the electroforming tank (not shown) filled with electroforming solution, whereas a metal material is disposed at the anode of the electroforming tank. While the anode and cathode are electrified, the metal ions are diffused from the metal material at the anode owing to electrolysis and evenly deposited on the mold 10 at the cathode. Since only the first sides 101*a* and 102*a* of the extension portions 101 and protrusions 102 of the mold 10 are conductive after the mold pretreatment step S111, the metal ions can be deposited only on partial surface, which means the first sides 101*a* and 102*a*, of the extension portions 101 and protrusions 102 of the mold 10 to form a conductive layer 103 (as shown in FIG. 3). Besides, since the first sides 101*a* of the extension portions 101 and the first sides 102*a* of the protrusions 102 of the mold 10 form a flat and continuous surface, the conductive layer 103 formed on the surface is a flat and continuous structure as well. The electroforming procedure is terminated after the predetermined thickness T of the conductive layer 103 is deposited.

In some embodiments, the metal material at the anode for performing the electroforming procedure in step S12 can be selected from a group consisting of copper, nickel, other metal or alloy. When copper is used as the metal material at the anode for electroforming procedure, the electroforming solution can be selected from the solution of copper sulphate, cupric borofluoride, or cupric pyrophosphate, so as to form a copper conductive layer on partial surface of the mold 10 at the cathode. While nickel is used as the metal material at the anode to perform electroforming procedure, the electroforming solution can be selected from a group consisting of nickel chloride solution, nickel borofluoride solution, and watts bath, so as to form a nickel conductive layer on partial surface of the mold 10 at the cathode. However, the selection of the metal material at the anode and the electroforming solution for electroforming procedure are not limited, which can be adjusted according to different requirements in order to form the conductive layer 103 with the material similar to the metal material at the anode. Moreover, the thickness T of the conductive layer 103 is not limited, which can be substantially smaller than 1 mm and preferably 0.3 mm, but not limited thereto. In other words, the thickness T of the conductive layer 103 can be increased or decreased by respectively prolonging or shortening the time of electroforming procedure. Of course, the purpose for modifying the thickness T of the conductive layer 103 can be achieved by adjusting some related electroforming parameters, such as current density, concentration of electroforming solution, and etc.

Please refer to FIG. 1 again, after the electroforming procedure of step S12 is performed, the conductive layer 103 is stripped from the mold 10 to obtain the conductive winding structure 20 (step S13). The method for stripping the conductive layer 103 from the mold 10 is not limited. For example, the conductive layer 103 can be separated from the first sides 101*a* and 102*a* of the extension portions 101 and the protrusions 102 of the mold 10 by vibration or super sonic, and the mold 10 can be rotated for stripping the conductive layer 103 from the mold 10, so as to obtain the spiral conductive winding structure 20 shown in FIGS. 4A and 4B. As shown in FIGS. 4A and 4B, the conductive winding structure 20 comprises a plurality of main bodies 201, a plurality of conductive pins 202, and a hollow portion 200. The main bodies 201 and the conductive pins 202 are respectively formed on the first sides 101*a* of the extension portions 101 and the first sides 102*a* of the protrusions 102 of the mold 10, and thus the main bodies 201 and the conductive pins 202 of the conductive winding structure 20 are corresponded to the extension portions 101 and the protrusions 102 of the mold 10, respectively. Therefore, it is to be understood that the conductive winding structure 20 of the present embodiment comprises four main bodies 201 and three conductive pins 202 integrally extended from the main bodies 201. In addition, since the extension portions 101 spirally surround the insulating axle portion 100 of the mold 10, the conductive winding structure 20 also comprises a hollow portion 200 piercing through main bodies 201 (as shown in FIG. 4B), wherein the hollow portion 200 is corresponded to the axle portion 100 of the mold 10.

Since the extension portions 101 and the protrusions 102 of the mold 10 are integrally formed, and the first sides 101*a* and 102*a* thereof form a flat and continuous surface, the conductive winding structure 20 formed thereon is an integral structure as well. In other words, the plurality of main bodies 201 and the plurality of conductive pins 202 are continuous and integrally formed (as shown in FIGS. 4A and 4B). In addition, though the conductive winding structure 20 comprises four main bodies 201, the soldering, folding, or bending process for fabricating the conductive winding structure with multiple windings in the conventional technique are no longer necessary. That is to say, the plurality of main bodies 201 and conducive pins 202 of the conductive winding structure 20 fabricated by electroforming are integrally formed without folding (as shown in FIGS. 4A and 4B), and thus fold resulted from folding can be prevented. Besides, since the precision of electroforming procedure is high, the non-uniform thickness of the conductive winding structure 20 can be avoided. Because the conductive winding structure 20 is directly derived from stripping the conductive layer 103 formed in step S12 from the mold 10, it is to be understood that the shape, material and thickness of the conductive winding structure 20 are the same as that of the conductive layer 103. In other words, the conductive winding structure 20 can be selected from copper, nickel or other conductive material, and the thickness T thereof is substantially smaller than 1 mm, preferably 0.3 mm, but not limited thereto.

Since the thickness of the conductive layer 103 is controlled by adjusting the parameters of the electroforming procedure in step S12, such as electroforming time, the thickness T of the conductive winding structure 20 can be reduced to less than 1 mm. In comparison with the conventional technique for forming the conductive winding structure by bending flat cable, the conductive winding structure 20 with relative larger width/thickness (W/T) ratio can be fabricated, and both of the requirements of structural integrity and thickness reduction of the conductive winding structure 20 can be conformed. Therefore, the production of thin conductive winding structure 20 with thickness less than 1 mm is practicable via the fabricating method of the present invention. In addition, since the integrally formed conductive winding structure 20 with plural main bodies 201 and conductive pins 202 can be fabricated by electroforming procedure, the conductive winding structure 20 with multiple windings can be fabricated merely through a single step of electroforming procedure. Thus the process for soldering the cut copper sheets or folding the single copper sheet for fabricating the conductive winding structure having multiple windings is no longer necessary, and the power loss resulted from the non-uniform thickness or fold of the conductive winding structure can be avoided, so as to improve the electrical property of the conductive winding structure. Moreover, since the shape of the conductive winding structure 20 depends on the design of the mold 10, it is to be understood that various kind of molds can be developed according to user's requirements. For example, the numbers of the extension portions 101 and the protrusions 102 of the mold 10 can be added for increasing the numbers of the main bodies 201 and the conductive pins 202 of the conductive winding structure 20. Of course, the position of the conductive pins 202 being disposed can be modified by changing the configuration of the mold 10, so as to fabricate different kinds of conductive winding structures 20 for raising the utility of the conductive winding structure 20.

Figure 5:
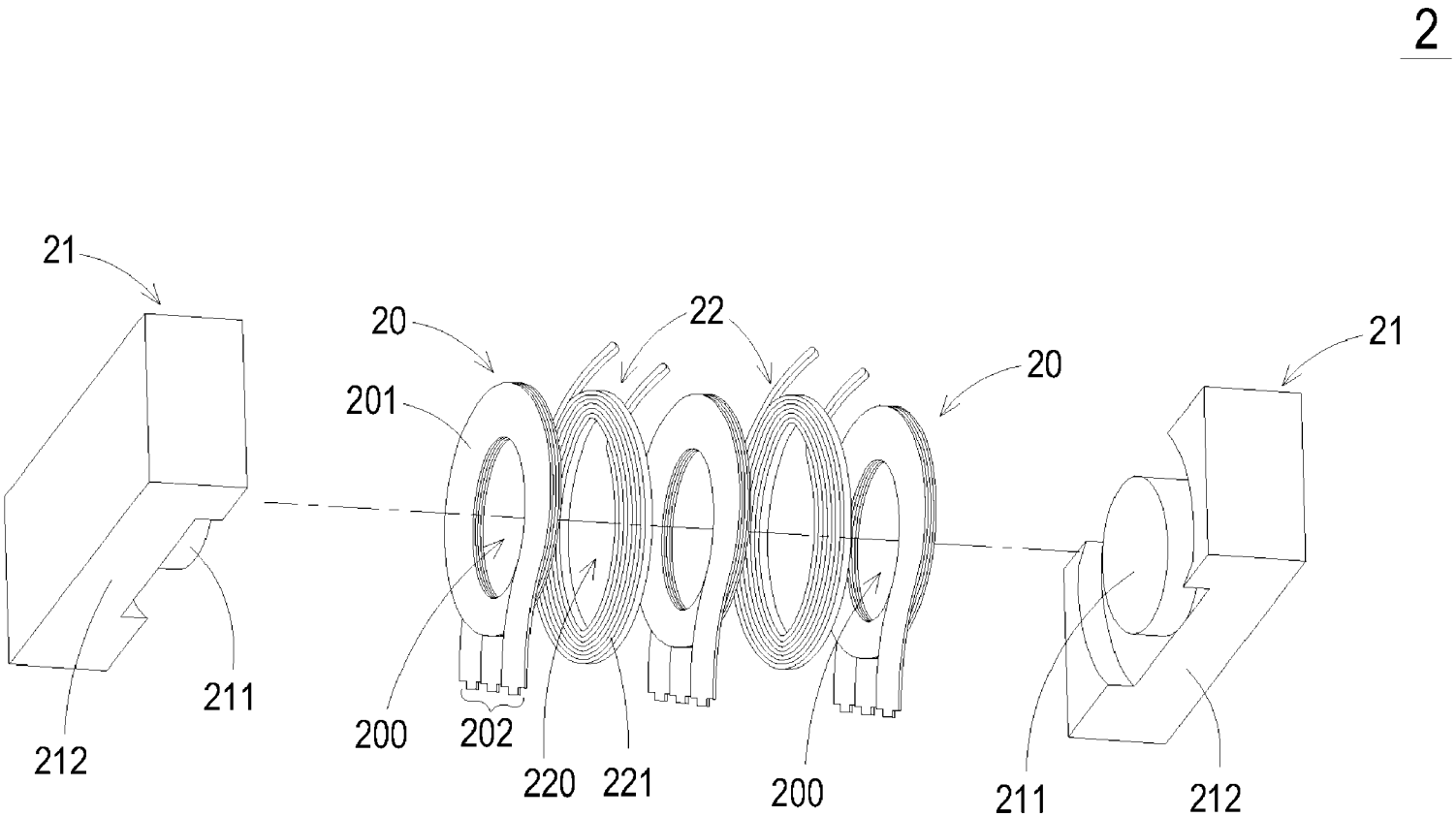
FIG. 5 is a schematic diagram showing the conductive winding structure of FIGS. 4A and 4B being applied in a transformer according to a preferred embodiment of the present invention.

The conductive winding structure 20 shown in FIGS. 4A and 4B can be applied to a magnetic device after the insulating layer is coated on the conductive winding structure 20 and the intervals between the main bodies 201 are compressed for overlapping the main bodies 201. The magnetic device is selected from a group consisting of transformer and inductance, but not limited thereto. Please refer to FIG. 5, which is a schematic diagram showing the conductive winding structure of FIGS. 4A and 4B being applied in a transformer according to a preferred embodiment of the present invention. As shown in FIG. 5, the transformer 2 comprises at least a conductive winding structure 20, a magnetic core 21 and at least a primary winding 22. The magnetic core 21 comprises a first magnetic portion 211 and a second magnetic portion 212. In this embodiment, the transformer 2 comprises two primary windings 22, each of which is a spiral wire cake formed by wound wire 221, and the shape of the primary winding 22 is substantially corresponded to that of the main bodies 201 of the conductive winding structure 20. That is to say, in this embodiment, the primary winding 22 can be circular spiral winding cake with a hollow portion 220 at the center. While assembling the transformer 2, a plurality of conductive winding structures 20 can be served as the secondary windings of the transformer 2. The conductive winding structures 20 and the primary windings 22 are disposed by turns, and the hollow portion 220 of each of the primary windings 22 is corresponded to the hollow portion 200 of each of the conductive winding structures 20. Therefore, the first magnetic portion 211 of the magnetic core 21 can pierce through and being disposed in the hollow portions 200, 220 of the conductive winding structures 20 and the primary windings 22, whereas the second magnetic portion 212 cover partial of the conductive winding structures 20 and the primary windings 22, so as to assemble the magnetic core 21 with the conductive winding structures 20 and the primary windings 22 to form the transformer 2. The transformer 2 can be electrically connected to other device, such as circuit board (not shown), through the conductive pins 202 of the conductive winding structures 20. Thus inductive voltage can be generated by the conductive winding structures 20 that serve as the secondary windings while the conductive winding structures 20 are inducted by the primary windings 22 base on electromagnetic induction, so as to achieve the purpose for regulating voltage by the transformer 2.

Figure 6:
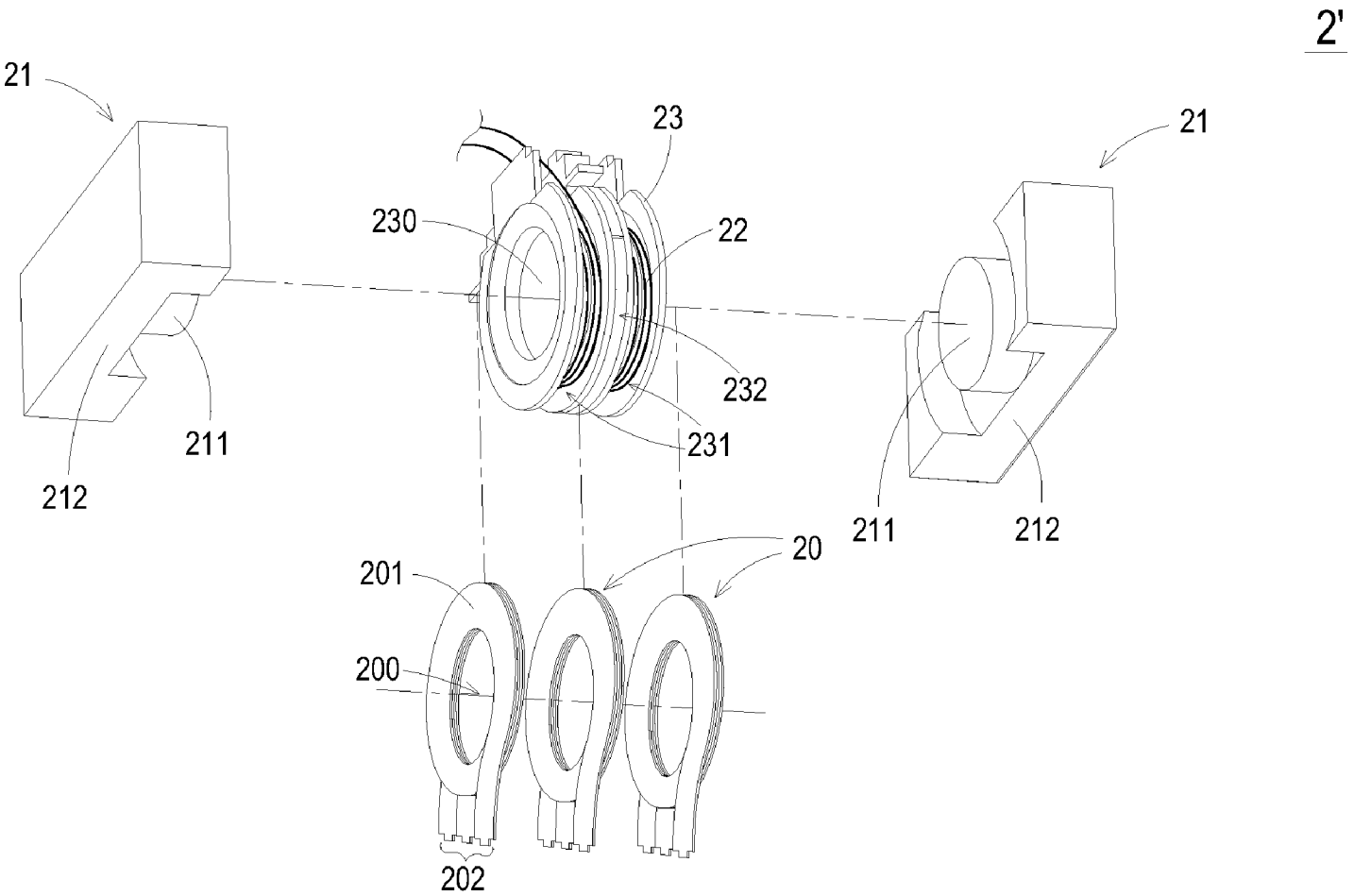
FIG. 6 is a schematic diagram showing the conductive winding structure of FIGS. 4A and 4B being applied in a transformer according to another preferred embodiment of the present invention.

Of course, the transformer comprises the conductive winding structure of the present invention is not limited to the foregoing embodiment. For example, as shown in FIG. 6, the transformer 2' further comprises a bobbin 23. The shape of the bobbin 23 is substantially similar to that of the main body 201 of the conductive winding structure 20, and the bobbin 23 comprises the structures of winding section 231, receiving portion 232 and hollow portion 230, wherein the hollow portion 230 pierces through the bobbin 23. The primary winding 22 of the transformer 2' can be wound on the winding section 231 of the bobbin 23. As the main bodies 201 of one of the conductive winding structures 20 is received in the receiving portion 232, and the main bodies 201 of the rest of the conductive winding structures 20 are respectively disposed at the opposite sides of the bobbin 23. However, the disposition of the conductive winding structures 20 depends on the number of the conductive winding structures 20 and the configuration of the bobbin 23. While the conductive winding structures 20 are assembled with the bobbin 23, the hollow portions 200 of the conductive winding structures 20 are corresponded to the hollow portion 230 of the bobbin 23. Accordingly, the first magnetic portion 211 can pierce through and being received in the hollow portions 200 of each conductive winding structure 20 and the hollow portions 230 of the bobbin 23, and partial of the conductive winding structures 20 and the bobbin 23 can be covered by the second magnetic portion 212 of the magnetic core 21, so as to assemble the magnetic core 21 with the conductive winding structures 20 and the bobbin 23 to form the transformer 2'. Similarly, the transformer 2' can be electrically connected to other device, such as circuit board (not shown), through the conductive pins 202 of each of the conductive winding structures 20, so the induction between the primary winding 22 and the conductive winding structures 20 can be created base on electromagnetic induction for the transformer 2' to regulate voltage.

Figure 7:
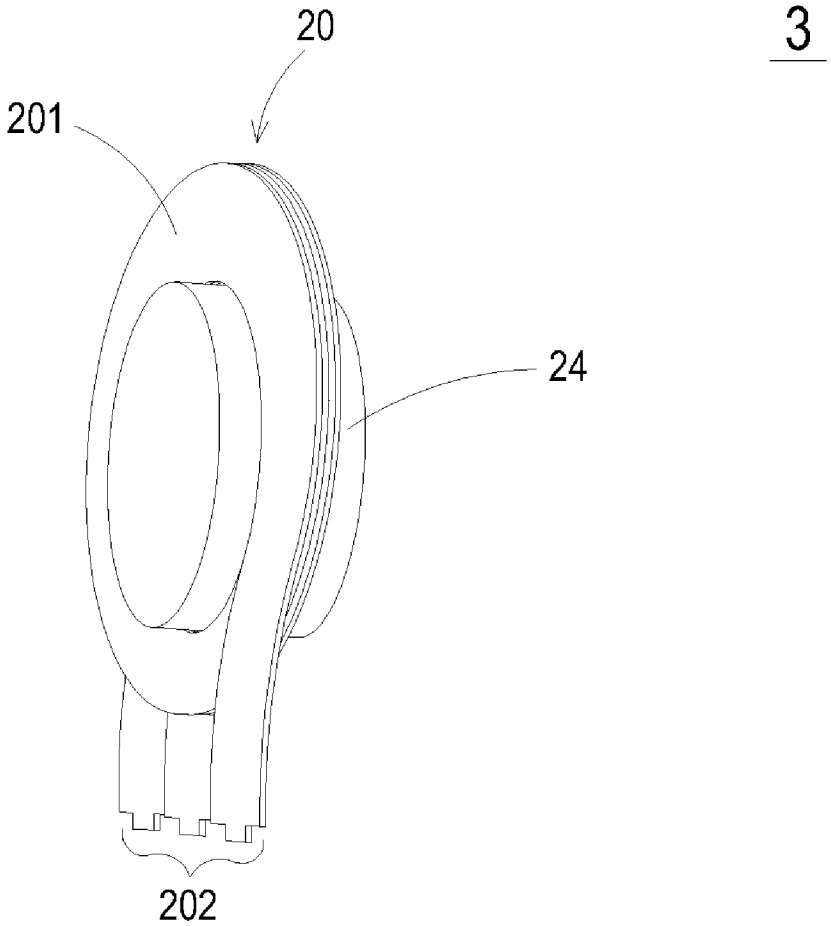
FIG. 7 is a schematic diagram showing the conductive winding structure of FIGS. 4A and 4B being applied in an inductance according to a preferred embodiment of the present invention.

In some embodiments, the magnetic core 24 can be assembled with the conductive winding structure 20 by the magnetic core 24 receiving in the hollow portion 203, so as to form the thin inductance 3 (as shown in FIG. 7). Accordingly, it is to be understood that the wire winding used in any kinds of magnetic devices can be replaced by the thin conductive winding structure 20 of the present invention.

According to the foregoing descriptions and the illustrations of FIG. 5 through FIG. 7, it is to be understood that the conductive winding structure 20 formed by the fabricating method of the present invention is a thin conductive winding structure 20, wherein the thickness T of each of the main bodies 201 and the conductive pins 202 can be reduced to less than 1 mm. Therefore, the volume of the transformer 2, 2' and the inductance 3 can be compressed as well, so as to match the trend of thinning the magnetic device. Of course, the volume of the electronic equipment, such as the power converter of the notebook, having the thin magnetic device therein can be reduced as well. Besides, since the main bodies 201 and the conductive pins 202 of each conductive winding structure 20 are integrally formed without folding, the power loss can be effectively prevented. Accordingly, the electrical properties and the efficiency of the transformer 2, 2' and the inductance 3 having the conductive winding structure 20 therein can be greatly improved.

Figure 8:
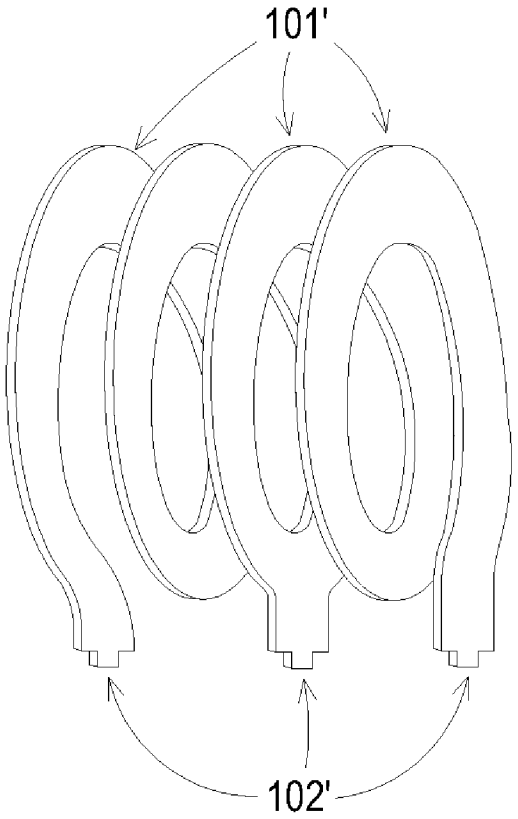
FIG. 8 is a schematic diagram showing the structure of the mold according to the other embodiment of the present invention.

Of course, the present invention is not limited to the foregoing embodiments, wherein the shape of the mold can be varied. For example, the structure of the mold 10' can be the same as that of the conductive winding structure 20 (as shown in FIG. 8). In other words, the mold 10' shown in FIG. 8 comprises the spiral extension portions 101' and the protrusions 102' extended from the edge of the extension portions 101', but the axle portion of the mold 10' is removed in comparison with the molds 10 in FIGS. 2A and 2B. Partial surface of the extension portions 101' and the protrusions 102' applied to contact with the conductive layer is conductive, while the remaining part of the mold 10' is insulated. Therefore, the conductive layer can be formed on the predetermined surface on the extension portions 101' and the protrusions 102' of the mold 10' while electroforming, and the conductive winding structure 20 can be obtained after the conductive layer is stripped from the mold 10'. Thus it is known that the configuration of the mold is unlimited. Moreover, since the configuration of the mold can be varied, the main bodies 201 of the conductive winding structure 20 formed by electroforming in accordance with the mold 10 can be circular (as shown in FIGS. 4A and 4B), rectangular, or other polygonal shape (not shown). Besides, the numbers of the main body 201 and the conductive pin 202 of each conductive winding structure 20 and the location where the conductive pins 202 being disposed are not limited, both of which can be modified by varying the configuration of the mold 10. Of course, though the thickness of the conductive winding structure 20 is preferred to be less than 1 mm in the foregoing embodiments, the thickness thereof can be increased by extending the electroforming time or adjusting other related parameters in step S12 to fabricate the conductive winding structure with thickness greater than 1 mm. So the conductive winding structure formed by the fabricating method of the present invention can be extensively applied in contrast with the conductive winding structure fabricated by the conventional techniques.

To sum up, the conductive winding structure is fabricated by forming a conductive layer on the mold through electroforming technique, and followed by stripping the conductive layer from the mold. Since the mold can be designed as a continuous structure, the conductive winding structure can be integrally formed without folding. In other words, through the method of the present invention, the processes of soldering metal sheets or folding a single metal sheet for forming the conductive winding structure with multiple windings are no longer necessary. Thus the non-uniform structure of the conventional conductive winding structure caused by soldering or folding can be avoided, and the impacts on the electrical properties of the conductive winding structure caused by folds can be prevented as well. Accordingly, the product yields and the efficiency of the conductive winding structure and the magnetic device having the same can be raised, so as to apply to the high efficiency electronic equipment.

Besides, since the conductive winding structure can be precisely formed by electroforming, the surface of the conductive winding structure is smooth, and the thickness thereof can be reduced to less than 1 mm. The magnetic device having the thin conductive winding structure therein and the electronic equipment having the magnetic device can be thinned and flatted as well. Moreover, the shape of the conductive winding structure formed by the fabricating method of the present invention can be modified by using the mold having different configurations, and the thickness of the conductive winding structure can be adjusted by controlling the parameters of electroforming procedure. Therefore, it is to be understood that various kind of conductive winding structures can be fabricated via the fabricating method of the present invention without requiring additional secondary processing. Since the foregoing advantages cannot be achieved by the conventional techniques, the conductive winding structure, the fabricating method thereof, and the magnetic device having the same are novel and non-obvious.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method for fabricating a conductive winding structure, said fabricating method comprising steps of:

(a) providing a mold comprising a plurality of extension portions and a plurality of protrusions, said plurality of extension portions are connected to each other as continuous spiral structure, and said plurality of protrusions are extended from said plurality of extension portions;

(b) performing an electroforming procedure to form a conductive layer on partial surface of said mold; and (c) stripping said conductive layer from said mold, so as to obtain said conductive winding structure.

2. The fabricating method according to claim 1, wherein said mold further comprises an axle portion substantially surrounded by said plurality of extension portions.

3. The fabricating method according to claim 2, wherein said conductive layer in step (b) is formed on partial surface of said plurality of extension portions and said plurality of protrusions of said mold.

4. The fabricating method according to claim 3, wherein said conductive winding structure in step (c) comprises a plurality of main bodies, a plurality of conductive pins, and a hollow portion respectively corresponded to said plurality of extension portions, said plurality of protrusions, and said axle portion of said mold.

5. The fabricating method according to claim 4, wherein said plurality of main bodies and said plurality of conductive pins of said conductive winding structure are integrally formed without folding.

6. The fabricating method according to claim 3, wherein said mold in step (a) is selected from a conductive material, and step (a) further comprises sub-step of: (a1) performing an insulating treatment on said mold to form an insulating medium on said mold except partial surface of said plurality of extension portions and said plurality of protrusions applied to contact with said conductive layer, so said conductive layer is formed on partial surface of said plurality of extension portions and said plurality of protrusions in step (b) via said conductive material.

7. The fabricating method according to claim 3, wherein said mold in step (a) is selected from an insulating material, and step (a) further comprises sub-step of: (a1) performing a conductive treatment on said mold to form a conductive medium on partial surface of said plurality of extension portions and said plurality of protrusions applied to contact with said conductive layer, so said conductive layer is formed on partial surface of said plurality of extension portions and said plurality of protrusions in step (b) via said conductive medium.

8. The fabricating method according to claim 1, wherein said conductive winding structure in step (c) is selected from a group consisting of copper and nickel, and the thickness of said conductive winding structure is substantially smaller than 1 mm.

* * * * *